US006818095B1

(12) United States Patent
Kim

(10) Patent No.: US 6,818,095 B1
(45) Date of Patent: Nov. 16, 2004

(54) CHEMICAL MECHANICAL POLISHING APPARATUS

(75) Inventor: Hyung Jun Kim, Chungcheongbuk-Do (KR)

(73) Assignee: Hynix Semiconductor Inc., Kyungki-Do (KR)

( * ) Notice: Subject to any disclaimer, the term of this patent is extended or adjusted under 35 U.S.C. 154(b) by 0 days.

(21) Appl. No.: 10/720,415

(22) Filed: Nov. 24, 2003

(30) Foreign Application Priority Data

May 9, 2003 (KR) ..... 10-2003-0029257

(51) Int. Cl.[7] ..... B24B 1/00; B24D 11/00
(52) U.S. Cl. ..... 156/345.12; 451/66
(58) Field of Search ..... 156/345.12, 345.13; 451/66, 101

(56) References Cited

U.S. PATENT DOCUMENTS 6,579,158 B2 * 6/2003 Tintelnot ..... 451/56
6,612,917 B2 * 9/2003 Bruxvoort ..... 451/533
6,632,129 B2 * 10/2003 Goetz ..... 451/533

* cited by examiner

*Primary Examiner*—P. Hassanzadet
*Assistant Examiner*—Sylvia R. MacArthur
(74) *Attorney, Agent, or Firm*—Marshall, Gerstein & Borun LLP

(57) ABSTRACT

Disclosed is a chemical mechanical polishing apparatus. A plurality of support poles, the heights and locations of which can be controlled and moved, are installed on a circular rotary table. A platen for polishing the surface of a wafer are divided in given shapes and are then attached to the plurality of the support poles, respectively. A chemical mechanical polishing process is performed in a state the platens are assembled to have a desired shape by moving the support poles or the pressure applied to the wafer is controlled every region by controlling the height of the support poles. Therefore, the present invention has an effect that it can obtain a uniform polishing characteristic by controlling the degree of polishing depending on regions of the wafer.

9 Claims, 4 Drawing Sheets

CHEMICAL MECHANICAL POLISHING APPARATUS

BACKGROUND

1. Field of the Invention

The present invention relates to a chemical mechanical polishing apparatus and, more particularly, to a chemical mechanical polishing apparatus capable of improving polishing uniformity.

2. Discussion of Related Art

A polishing method that has been used in an existing chemical mechanical polishing (CMP) equipment is a method of attaching polyurethane pad to a circular table made with rigid metal or ceramic and polishing the wafer while supplying the slurry on the pad. In this method, the polishing speed and uniformity are controlled depending on the speed of a platen to which the pad is attached, the speed of a head to which a wafer is attached, and the pressure applied to the rear of the wafer. Of them, in order to improve polishing uniformity, a multi-zone pressure method in which the pressure applied to the rear of the wafer is partially differentiated is used in chemical mechanical polishing.

Even with such advancement in the equipments, however, since it is difficult to fundamentally cope with irregularity problem of polishing at the edge of the wafer and a warpage problem, there may be a problem that polishing residue is left after the chemical mechanical polishing process, or one can't control polishing rate.

SUMMARY OF THE INVENTION

The present invention is contrived to solve the aforementioned problems. The present invention is directed to provide a chemical mechanical polishing apparatus capable of obtaining a uniform polishing characteristic by controlling the degree of polishing depending on regions of a wafer, in such a manner that a plurality of support poles whose heights/locations can be controlled/moved are installed on a circular rotary table, a platen for polishing the surface of a wafer are divided into given shapes and are then attached to the plurality of the support poles, respectively, and a chemical mechanical polishing process is performed in a state the platens are assembled to have a desired shape by moving the support poles or the pressure applied to the wafer is controlled every region by controlling the height of the support poles.

According to one aspect of the present invention for achieving the object, there is provided a chemical mechanical polishing apparatus, including a circular rotary table, a driving shaft for rotating the circular rotary table, a plurality of support poles installed on the circular rotary table, wherein the support poles can be controlled in height and moved horizontally by sliding, and platen pieces each attached to the plurality of the support poles, wherein a platen of a new shape is assembled by horizontally moving the support poles or the pressure applied to a wafer is controlled every region by controlling the height of the support pole.

In the above, the support pole may have a hollow support rod for blowing off the slurry from its inner space. Further, an exhaust port for blowing off the slurry through the space between the platen pieces from the exhaust port may be installed at the circular rotary table between the support poles.

The platen pieces may include pieces of the platen that are divided in a checker pattern. The platen pieces may also include pieces that are divided into edges of a given width and a quadrilateral central portion in the platen. Meanwhile, different platen pieces may be attached to the central portion and the edge of the circular rotary table to control a polishing characteristic every region.

A pad in which a groove is formed at the interface between the platen pieces is attached to the platen piece. At this time, the pad may include an abrasive-embedded pad.

BRIEF DESCRIPTION OF THE DRAWINGS

The above and other objects, features and advantages of the present invention will become apparent from the following description of preferred embodiments given in conjunction with the accompanying drawings, in which.

DETAILED DESCRIPTION OF PREFERRED EMBODIMENTS

Figure 1:
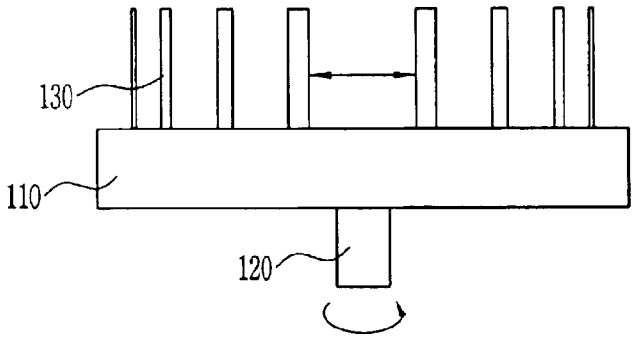
FIG. 1 is a conceptual view shown to explain a polishing element of a chemical mechanical polishing apparatus according to the present invention.

The present invention will now be described in detail in connection with preferred embodiments with reference to the accompanying drawings, in which like reference numerals are used to identify the same or similar parts.

FIG. 1 is a conceptual view shown to explain a polishing element of a chemical mechanical polishing apparatus according to the present invention.

Referring to FIG. 1, a polishing element of a chemical mechanical polishing apparatus according to an embodiment of the present invention includes a circular rotary table 110; a driving shaft 120 for rotating the circular rotary table 110, and a plurality of support poles 130 formed on the circular rotary table 110. In the above, the support poles 130 can be controlled in height in a vertical direction and can also be independently moved on the circular rotary table 110 in a horizontal direction by sliding. Further, each support pole 130 may consist of a hollow support rod whose inner side is empty (its internal empty space is not shown) in order to blow off the slurry. Meanwhile, in case that the support pole 130 is made of a simple support rod, a blown-off port (not shown) for blowing off the slurry may be installed in the circular rotary table 110 between the support poles 130. Such slurry is supplied from the outside through the slurry supplying hole on pad and may be supplied to the wafer through the support poles 130 consisting of the hollow support rods or the exhaust port installed in the circular rotary table 110.

Figure 2:
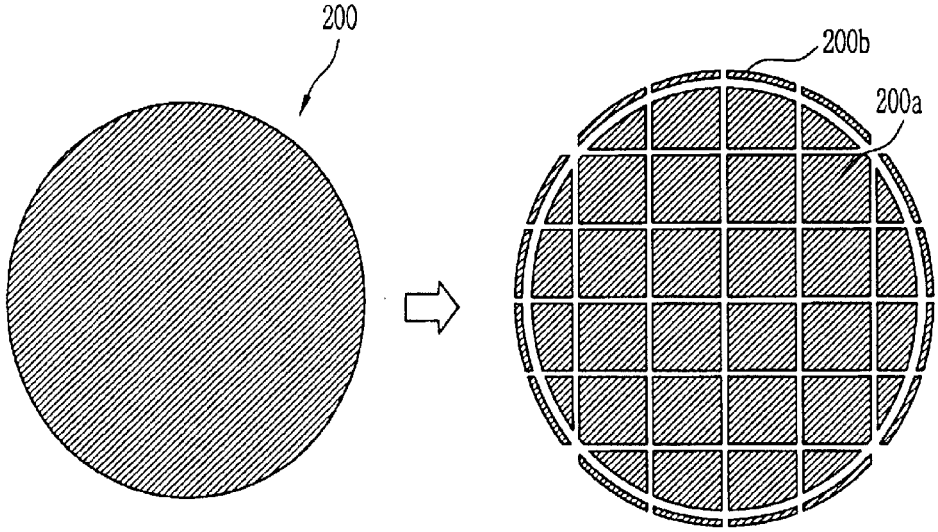
FIG. 2 illustrates a platen for polishing the surface of a wafer that is divided in given shapes.

FIG. 2 illustrates a platen for polishing the surface of the wafer that is divided into given shapes.

By reference to FIG. 2, a circular platen 200 for polishing the surface of the wafer is divided into given shapes. It is preferred that the platen 200 can be divided into various shapes and can be divided in a checker. Further, only edges 200*b* can be individually divided to have a given width, while the platen 200 are divided into certain shapes. Such platen pieces 200*a* and 200*b* are installed on the support pole 130 of the polishing element shown in FIG. 1.

Figure 3:
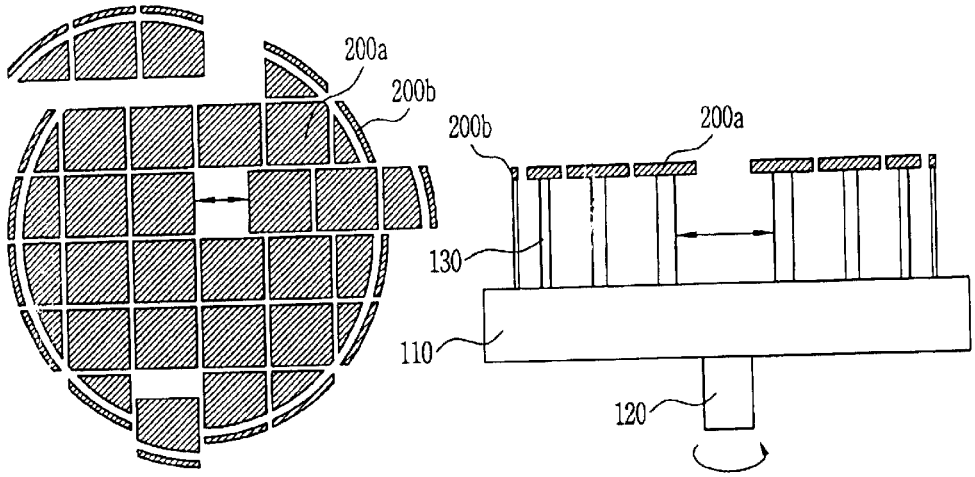
FIG. 3 shows that platen pieces in FIG. 2 are mounted on the polishing element in FIG. 1, and can be assembled by horizontally moving.

FIG. 3 shows a state where the platen pieces in FIG. 2 are mounted on the polishing element in FIG. 1.

With reference to FIG. 3, the platen pieces 200*a* and 200*b* that are divided into the given shapes are mounted on the support pole 130 installed in the circular rotary table 110 of the polishing element. At this time, a platen of a new shape can be assembled using the platen pieces 200*a* and 200*b*, by moving the support poles 130 with the platen pieces 200*a* and 200*b* attached to the support pole 130.

Furthermore, different platen pieces of two or more types may be attached to the support pole 130. In this case, different platen pieces may be attached to a central portion and an edge portion in order to control a polishing characteristic every region.

Meanwhile, pads are attached to the platen pieces. In order to prevent a scratch in the chemical mechanical polishing process, a groove of the pad may be formed at the interface between the divided platen pieces. The pad may also include an abrasive-embedded pad.

Figure 4:
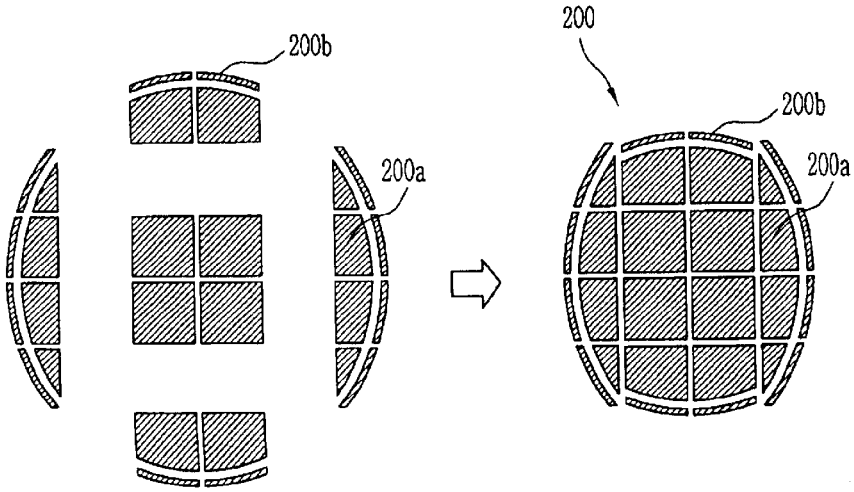
FIG. 4 shows a state where a platen of a new shape is assembled using the platen pieces.

FIG. 4 shows a state where the platen of a new shape is assembled using the platen pieces.

Referring to FIG. 4, the platen 200 of a new size and shape may be assembled using only a portion of the platen pieces by moving the support pole (130 in FIG. 3). In the concrete, if the height of the support pole to which the platen pieces 200*a* and 200*b* used to assembly the platen 200 of the new size and shape keeps intact and the heights of the support poles to which the platen pieces (not shown) exclusive of the assembly is lowered, it is possible for the platen pieces excluded from the assembly not to give any influence on the polishing.

Figure 5A:
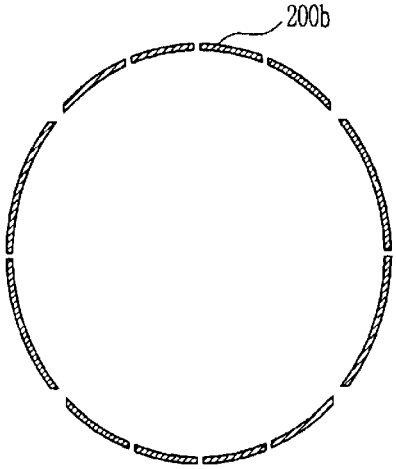
FIGS. 5A and 5B show states where platens of another shapes are assembled using the platen pieces.
Figure 5B:
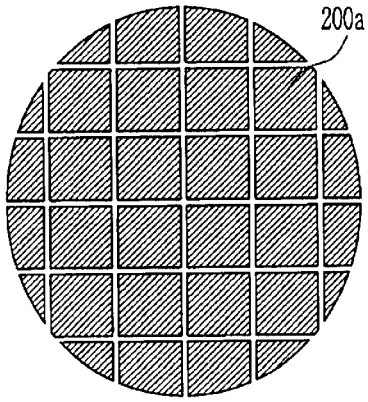

FIGS. 5A and 5B show states where platens of another shapes are assembled using the platen pieces.

By reference to FIG. 5A, if the height of the support pole to which the platen pieces (not shown) corresponding to the central portion are attached is lowered in a state where the height of the support pole to which the platen pieces 200*b* at the edge are attached keeps intact, only the platen pieces 200*b* at the edge are brought into contact with the wafer in the polishing process, so that only the edge of the wafer can be polished.

With reference to FIG. 5B, on the contrary, if the height of the support pole to which the platen pieces (not shown) corresponding to the central portion are attached is lowered in a state where the height of the support pole to which the platen pieces 200*a* at the central portion are attached keeps intact, only the platen pieces 200*a* at the central portion are brought into contact with the wafer in the polishing process, so that only the central portion of the wafer can be polished.

Figure 6:
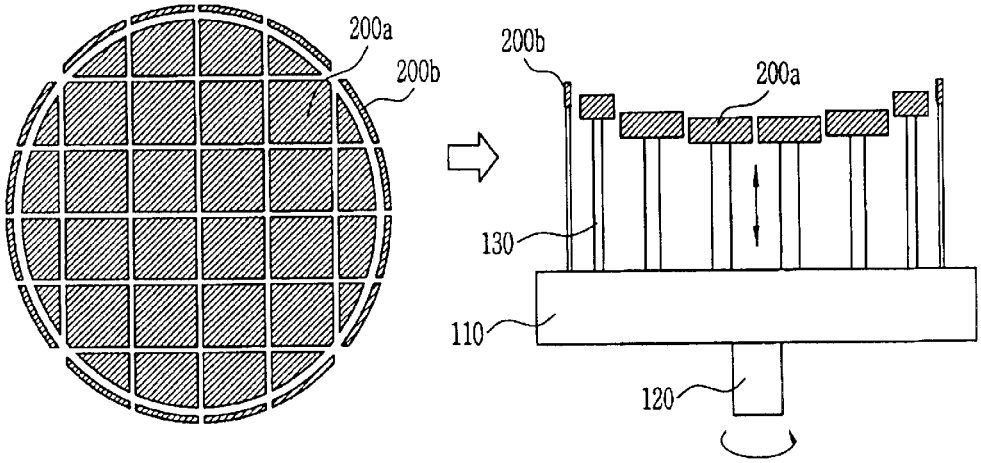
FIG. 6 illustrates a case where the height of a support pole is controlled so that different pressures are applied by regions with the platen pieces attached thereto.

FIG. 6 illustrates a case where the height of a support pole is controlled so that different pressures are applied by regions with the platen pieces attached thereto; and With reference to FIG. 6, in the event that the polishing characteristic at the edge of the wafer is not good as a result of measuring polishing characteristics after chemical mechanical polishing is performed, the polishing characteristic at the edge can be improved by making the height of the support pole located at the edge of the circular rotary table 110 higher than that of the support pole located at the central portion. Though not shown in the drawing, it will be opposite to the above where the polishing characteristic at the central portion of the wafer is not good.

Figure 7A:
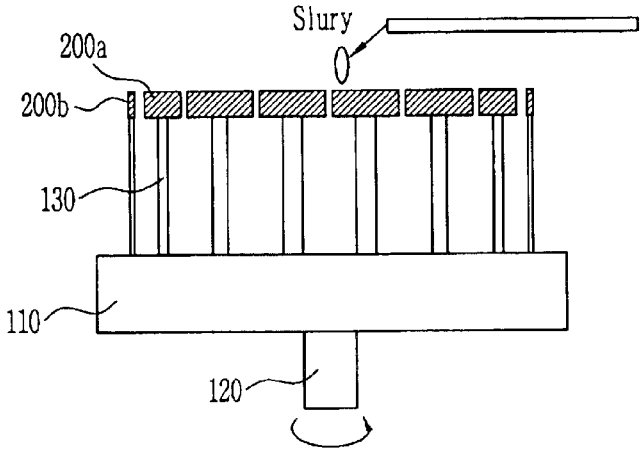
FIGS. 7A to 7C illustrate how the slurry is supplied at the time of a chemical mechanical polishing process.
Figure 7B:
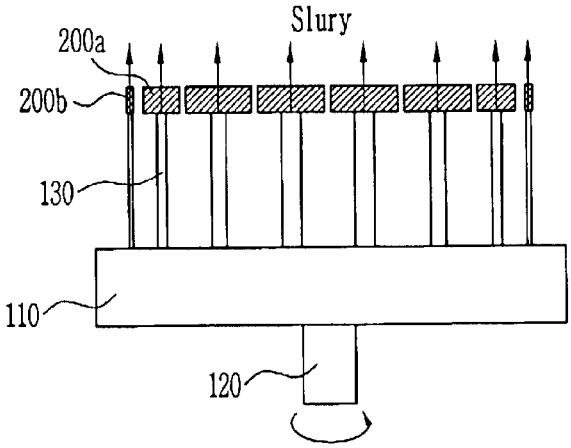
Figure 7C:
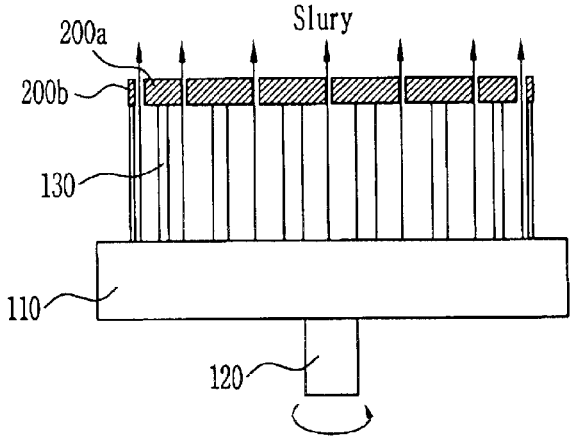

FIGS. 7A to 7C illustrate how the slurry is supplied in the chemical mechanical polishing process.

By reference to FIG. 7A, in the chemical mechanical polishing process, the slurry is supplied onto the top of the divided platen pieces 200*a* and 200*b* and the polishing process may be then performed by the centrifugal force.

Referring to FIG. 7B, in the case where the support pole 130 is made of the hollow support rod, the slurry is upwardly blown off from the support pole 130 through its inner space. In this case, though not shown in the drawings, it is required that the slurry supply hole be provided in a pad that will be attached to the divided platens 200*a* and 200*b*.

With reference to FIG. 7C, in the case where the support pole 130 consists of a simple support rod and the exhaust port (not shown) for blowing off the slurry is installed in the circular rotary table 110 between the support poles 130, the slurry may be supplied through the space between the platen pieces 200*a* and 200*b* from the exhaust port installed in the circular rotary table 110.

Furthermore, it is to be understood that the slurry may be supplied by using a combination of any of the above methods.

Meanwhile, when an end point detector (EPD) is applied in the process of performing chemical mechanical polishing while supplying the slurry in the same manner as the above, the polishing end time may be decided by a method of a light source injection through a pad hole, a method of a light source injection through a crack between separated platens, a method of analyzing components of a polishing residue induced through the support pole consisting of the hollow support rod, a method of analyzing components of a polishing residue induced into the circular rotary table through a gap between the divided platens, a method of detecting variation in a motor current of a power-driven motor that drives a rotating shaft, or a method of detecting characteristics of the pad attached on the platen.

As described above, according to the present invention, a plurality of support poles, the heights and locations of which can be controlled and moved, are installed on a circular rotary table. A platen for polishing the surface of a wafer are divided into given shapes and are then each attached to the plurality of the support poles. A chemical mechanical polishing process is performed in a state the platens are assembled to have a desired shape by moving the support poles or the pressure applied to the wafer is controlled every region by controlling the height of the support poles. Therefore, the present invention has an effect that it can obtain a uniform polishing characteristic by controlling the degree of polishing depending on regions of the wafer.

Although the present invention has been described in connection with the embodiment of the present invention illustrated in the accompanying drawings, it is not limited thereto. It will be apparent to those skilled in the art that various substitutions, modifications and changes may be made thereto without departing from the scope and spirit of the invention.

What is claimed is:

1. A chemical mechanical polishing apparatus, comprising:

a circular rotary table;

a driving shaft for rotating the circular rotary table;

a plurality of support poles installed on the circular rotary table, wherein the support poles can be controlled in height and moved horizontally by sliding; and platen pieces attached to the plurality of the support poles, respectively, wherein a platen of a new shape is assembled by horizontally moving the support poles, or the pressure applied to a wafer is controlled by regions by controlling the height of the support poles.

2. The chemical mechanical polishing apparatus as claimed in claim 1, wherein the support pole has a hollow support rod for blowing off slurry from its inner space.

3. The chemical mechanical polishing apparatus as claimed in claim 1, wherein an exhaust port is installed at the circular rotary table between the support poles, from which slurry is blown off through a space between the platen pieces.

4. The chemical mechanical polishing apparatus as claimed in claim 1, wherein the platen pieces are pieces of the platen that are divided in a checker pattern.

5. The chemical mechanical polishing apparatus as claimed in claim 4, wherein the platen pieces are pieces that are divided into an edge of a given width and a quadrilateral central portion in the platen.

6. The chemical mechanical polishing apparatus as claimed in claim 1, wherein the platen pieces are pieces that are divided into an edge of a given width and a quadrilateral central portion in the platen.

7. The chemical mechanical polishing apparatus as claimed in claim 1, wherein different platen pieces are attached to the central portion and the edge of the circular rotary table to control a polishing characteristic by regions.

8. The chemical mechanical polishing apparatus as claimed in claim 1, wherein a pad, in which a groove is formed at an interface between the platen pieces, is attached to the platen piece.

9. The chemical mechanical polishing apparatus as claimed in claim 8, wherein the pad includes an abrasive-embedded pad.

* * * * *